United States Patent [19]

Eder

[11] 4,395,839

[45] Aug. 2, 1983

[54] FIRING PIN SAFETY DEVICE FOR FIREARMS

[76] Inventor: Josef Eder, Anton-Burgmeier-Str. 3a, 8060 Dachau, Fed. Rep. of Germany

[21] Appl. No.: 140,979

[22] Filed: Apr. 17, 1980

[30] Foreign Application Priority Data

Jul. 19, 1979 [DE] Fed. Rep. of Germany ..... 2929289
Sep. 24, 1979 [DE] Fed. Rep. of Germany ..... 2938600

[51] Int. Cl.[3] ..... F41C 17/04
[52] U.S. Cl. ..... 42/70 F
[58] Field of Search ..... 40/70 F, 66

[56] References Cited

U.S. PATENT DOCUMENTS 109,514 11/1870 Hay ..... 42/70 F
3,086,310 4/1963 Katz ..... 42/70 F
3,724,113 4/1973 Ludwig ..... 42/70 F

*Primary Examiner*—Charles T. Jordan
*Attorney, Agent, or Firm*—Cushman, Darby & Cushman

[57] ABSTRACT

In a firearm having a barrel for receiving a cartridge, a firing pin having forward and rear ends and being movable between a cartridge-engaging firing position and an at-rest position and a trigger movable toward a firing position, an improved movable locking device for preventing movement of the firing pin to its firing position and, in response to movement of the trigger toward a firing position, for releasing said firing pin, said locking device being mounted in said barrel for movement between a locking position in which said device blocks movement of said firing pin to its firing position and an unlocking position in which said device is out of locking contact with said firing pin.

12 Claims, 15 Drawing Figures

FIRING PIN SAFETY DEVICE FOR FIREARMS

This invention relates to a firing pin safety device for a firearm, particularly a firing pin locking device which is actuated by the trigger to move from a locking position to an unlocking position when the firearm is being fired.

BACKGROUND

It is known to provide various forms of automatic firing pin safety devices in addition to the usual safety catch, safety pin, safety lever and the like. Such firing pin safety devices are provided to prevent contact of the firing pin with the cartridge and consequent discharge of the firearm, after the usual safety catch or the like has been released, in the event that the firearm is dropped or otherwise subjected to impact. In one known arrangement in a hand gun the safety device comprises an element which is resiliently mounted on a movable part of the weapon and which is actuated by the trigger via the hammer.

SUMMARY OF THE INVENTION

The present invention simplifies the construction of a trigger-actuated, safety-pin-locking device by mounting the device in the barrel of the weapon. The term barrel is intended to mean that non-moving portion of the weapon which is adjacent to or surrounds the cartridge and/or at least the forward end of the firing pin. The term barrel therefore includes the receiver portion of the weapon.

The device is arranged so that it normally blocks movement of the firing pin into engagement with the cartridge. Upon actuation of the trigger the device is moved to a position in which the firing pin can move under the action of the hammer or the like.

Since the locking device is substantially arranged in the stationary part of the weapon, the actuation is much simpler and considerably less expenditure of technical equipment is necessary than where the locking device is arranged in a movable part of the weapon.

The locking device is preferably adapted to be actuatable directly by the trigger.

The locking device can comprise a lever pivoted intermediate its ends in the barrel in the manner of a rocker arm. One end of the lever is actuated by the trigger and the other end is engageable with a collar, shoulder or the like on the firing pin. The lever is usefully arcuate or bow-shaped and, if the weapon is a center fire weapon, it may be arranged in a recess provided vertically above and laterally offset from the hollow receiver portion of the barrel. A return spring is included to bias the lever in a non-locking position.

If the weapon is a rim fire weapon, the pivoted lever can be placed in a recess which is parallel to the hollow of the barrel (receiver portion) located on the side of the barrel facing away from the trigger, and the lever can be actuated by a pin, bolt or the like which can be moved up and down and which extends around the hollow space of the barrel. There may be provided a return spring in the portion of the pivoted lever at the side of the firing pin. In addition, the pin, bolt or the like can, on the side of the center of rotation of the trigger facing away from the firing pin, rest upon an inclined plane of said trigger.

It is also possible that the locking device can be constituted by a block, slide, bolt, pin or the like or include the latter.

According to another embodiment of the invention, the locking device itself is spring-mounted. It is however also possible to have the locking device connected to the trigger. In this case, the locking device can be actuatable via a pin, roller or the like extending in a recess of the trigger.

In case of a rim fire hand firearm the locking device can have a projection or the like acting upon the front area of the firing pin.

In a center fire hand firearm, the locking device can consist of a slide or the like which is movable vertically to the axial movement of the firing pin and to include a rod cooperating with the slide and engaging a collar, a shoulder or the like on the firing pin.

The locking device may have a portion which is placed on one side of the hollow space in the barrel and which cooperates with a fork-shaped projection of the trigger. The trigger has preferably at least on one fork-shaped projection or the like an inclined surface cooperating with the locking device.

DETAILED DESCRIPTION

Figure 1:
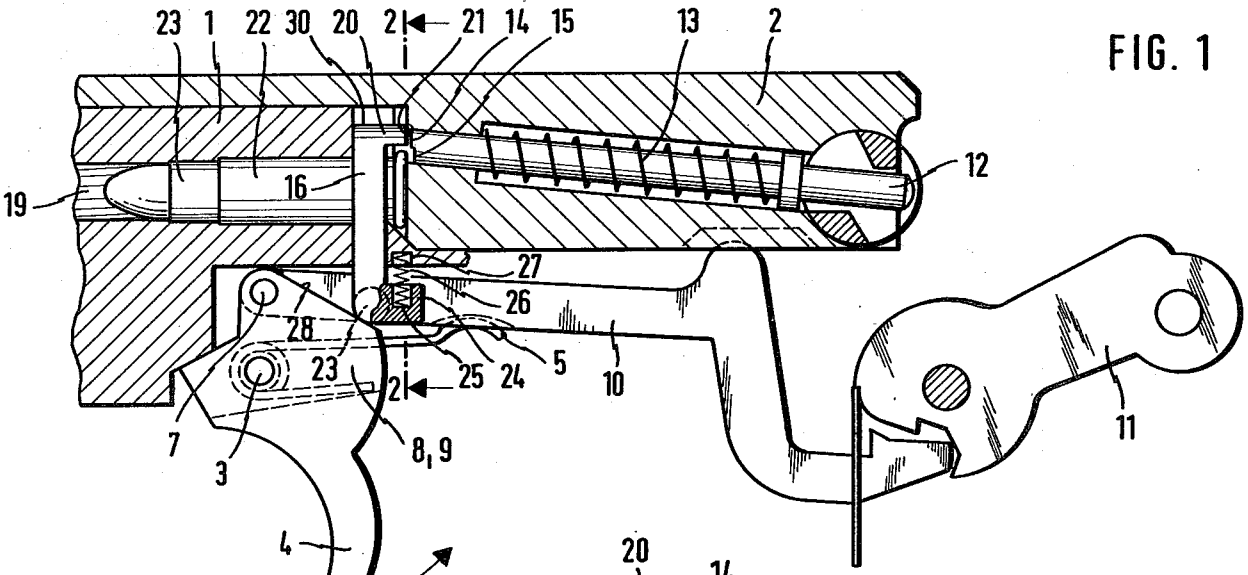
FIG. 1 is a fragmentary longitudinal section through part of a firearm illustrating a first embodiment of the invention.

According to the embodiment shown in FIG. 1, a rim fire pistol whose further details are not shown includes a barrel 1 and a movable carriage 2. At the barrel 1, there is mounted a trigger 4 which can be manually pivoted about a pin or bolt 3 against the action of a spring 5 in the direction of the arrow 6.

The forward end of a trigger rod 10 is retained between two fork-shaped projections 8 and 9 on the trigger 4 by means of a pin or bolt 7. The rearward end of the trigger rod 10 cooperates with a hammer 11 in the usual manner.

A firing pin 12 is obliquely mounted in the carriage 2 for axial movement against the action of a spiral compression spring 13. The front end 14 of the firing pin 12 extends approximately vertically relative to the axis of the barrel 1 and includes a shoulder area 15. In a lateral milled indentation of the barrel 1, there is placed a locking device in the form of a slide 16 which is movable vertically relative to the barrel axis; the slide constitutes the locking device for the firing pin 12. As described more in detail below the slide 16 is in a locking position when in an up position and is in an unlocking position when in a lower position.

Figure 2:
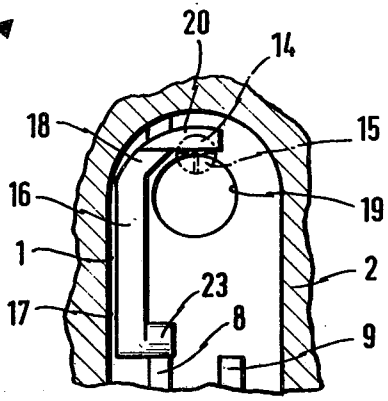
FIG. 2 is a sectional view taken along line 2—2 of FIG. 1.

As seen in FIG. 2, the slide 16 extends alongside a side face 17 of the barrel 1 and has an extension 18 which extends over the drilled hollow space 19 of the barrel 1. A projection 20 on the slide 16 has a frontal area 21 which in the locking position of the slide 16 is in contact with the front end portion 14 of the firing pin 12. If the trigger 4 is not actuated, the firing pin 12 cannot strike upon the cartridge case 22 of the cartridge 23 located in the barrel 1.

The slide 16 has at its lower end a step 23 directed toward the trigger rod 10. A projection 24 extending parallel to the trigger rod is connected to the step 23. In a groove 25 in the projection 24, there is inserted one end of a coil compression spring 26 for returning the locking device to its locking position, whereas the other end of the spring rests in a recess 27 provided in the barrel 1.

As can be seen from FIG. 1, the step 23 slides on an oblique surface 28 of the projection 8 on the trigger 4. Unlocking of the locking device is only possible by actuation of the trigger 4 in the direction of the arrow 6, the cooperation of the slope or inclined plane 28 and the step 23 not only leading to unlocking of the firing pin 12 but simultaneously blocking further movement of the trigger 4.

Figure 3:
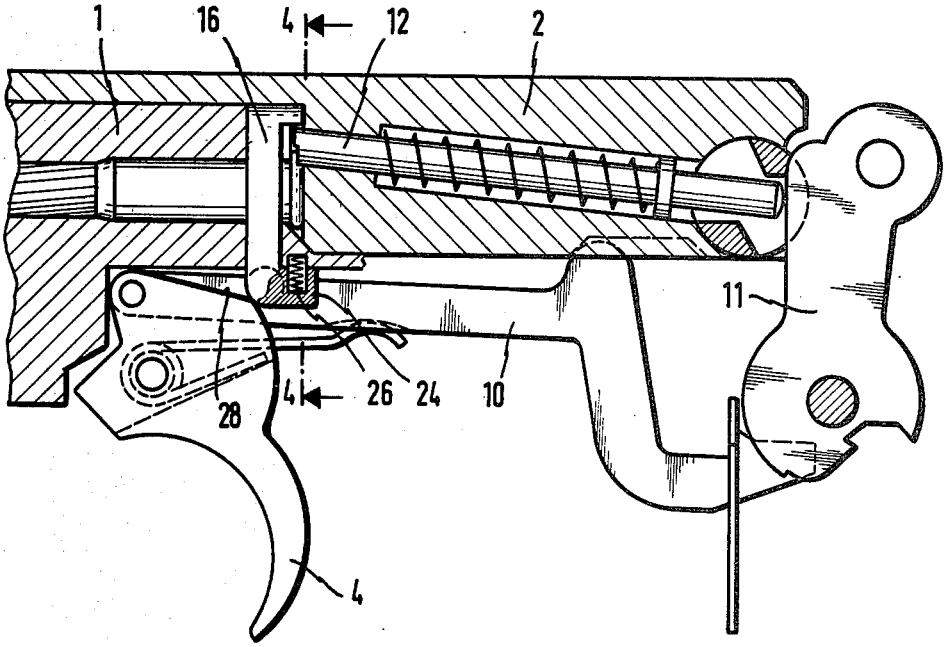
FIG. 3 is a longitudinal section similar to FIG. 1 showing another trigger position.

As can be seen from FIG. 3, the spring 26 is compressed and the upper edge 30 of the projection 24 rests against the lower side of the barrel 1.

As has been mentioned above there can be provided, instead of the slide, a pivoted lever which on actuation by the trigger 4 releases the frontal area 14 of the firing pin 12. This pivotal movement of the pivoted pin can be in a direction parallel to the plane of the drawing or in a direction vertical to the plane of the drawing.

Figure 4:
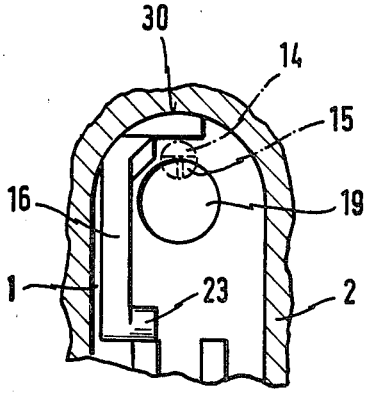
FIG. 4 is a sectional view taken along line 4—4 of FIG. 3.

FIG. 4 shows that the upper edge 30 of the slide 16, in the unlocked position of the locking device, is flush with the upper edge of the carriage 2. It can also be seen from FIG. 3 how the hammer 11 strikes the firing pin 12.

Figure 5:
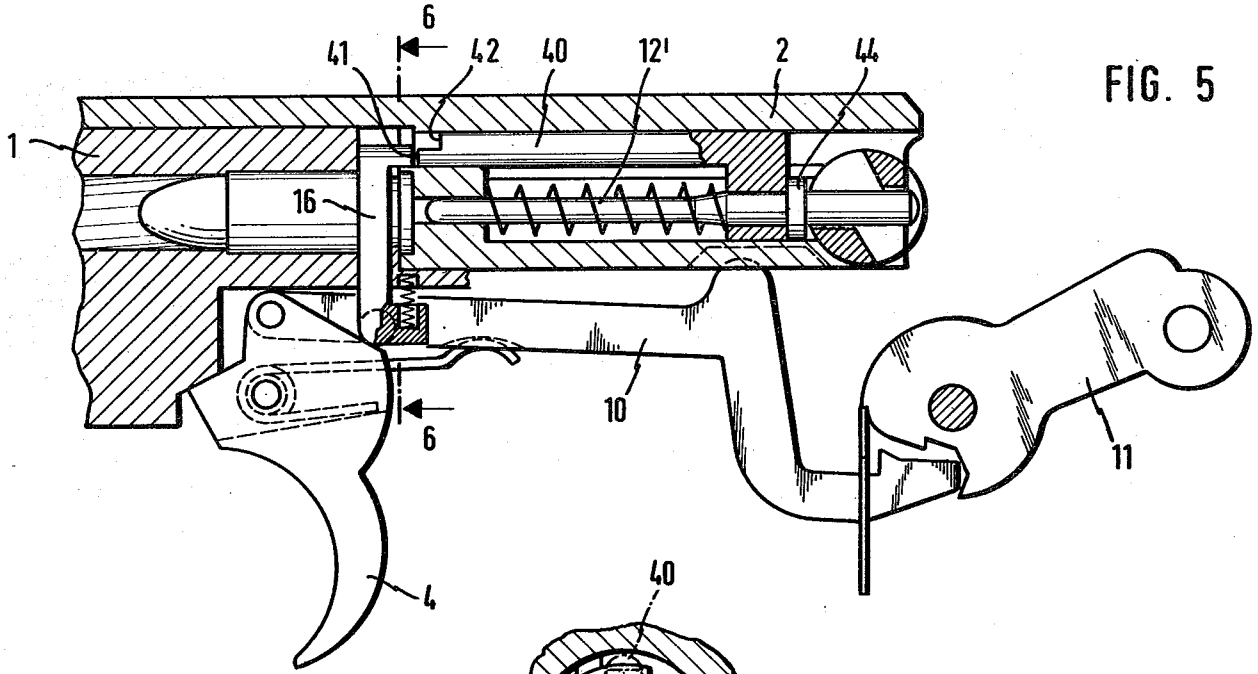
FIG. 5 is a longitudinal section through a second embodiment.
Figure 6:
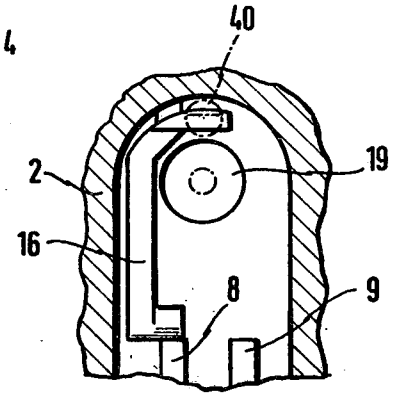
FIG. 6 is a sectional view taken along line 6—6 in FIG. 5.

FIGS. 5 to 8 relate to a center-fire pistol. The carriage 2 is movably mounted on the barrel 1 and the trigger 4 has the same shape as in the embodiment of FIGS. 1–4. The firing pin 12', however, extends coaxially relative to the hollow space 19 of the barrel 1 and has a compression spring 13 constituting the return spring. The slide 16 has generally the same shape as in the previous embodiment. In the embodiment shown in FIGS. 5 to 8 there is placed above the firing pin 12' a cylindrical rod 40 which is movable in the axial direction of the barrel 1. The front end of the rod has a step or offset 41 or 42, the step 41 cooperating with the frontal area 21 of the slide 16 when the latter is in a locking position (FIG. 5). In the unlocking position of the slide 16 (FIG. 7) the front end of the rod 40 is free of the slide 16.

Figure 7:
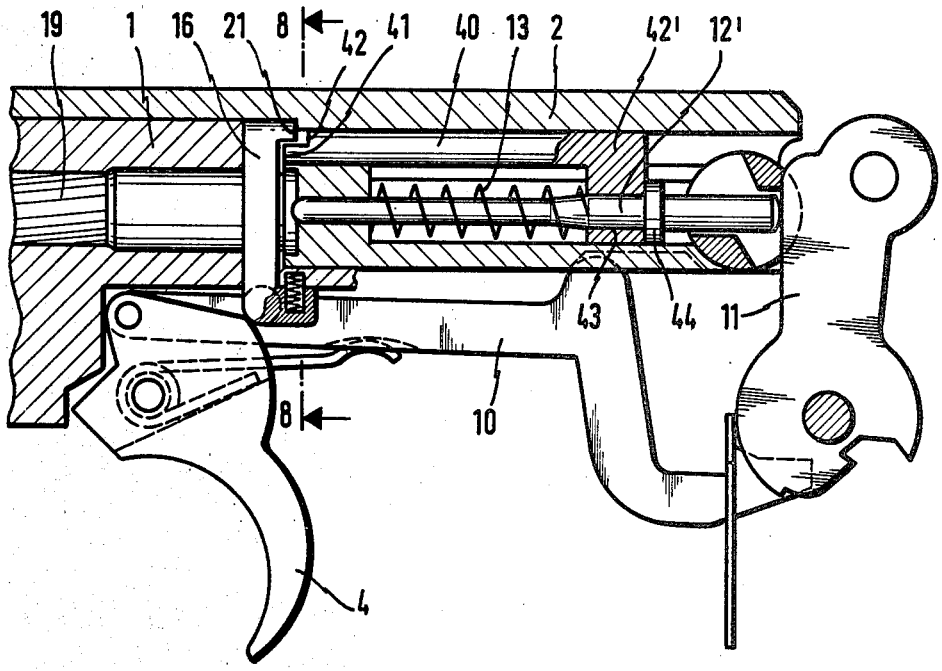
FIG. 7 is a longitudinal section similar to FIG. 5, showing another trigger position.
Figure 8:
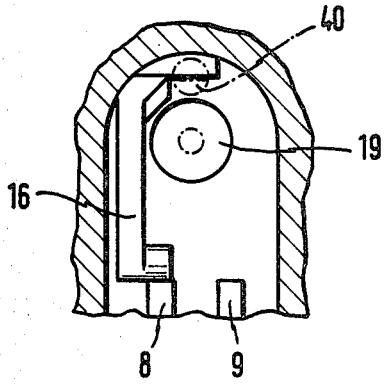
FIG. 8 is a sectional view taken along line 8—8 of FIG. 7.

The rear end 42' of the rod 40 extends downwardly toward the firing pin 12' and has a recess 43 through which the firing pin 12' extends. A collar 44 provided on the firing pin 12' is in engagement with the rear face of the end 42' of the rod 40 so that the rod 40 and firing pin 12', as can be seen from FIG. 5, are prevented from moving forward. In FIG. 7 the rod 40 and firing pin 12' are shown in their released position.

Figure 9:
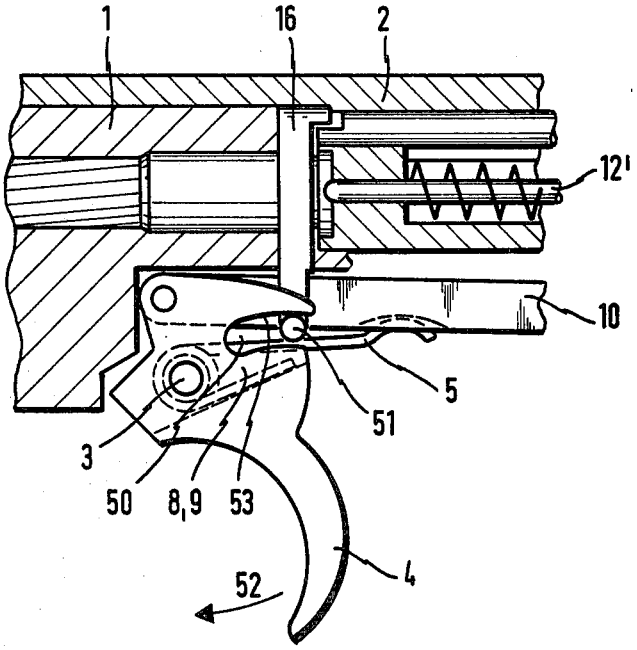
FIG. 9 is a longitudinal section through a third embodiment.
Figure 10:
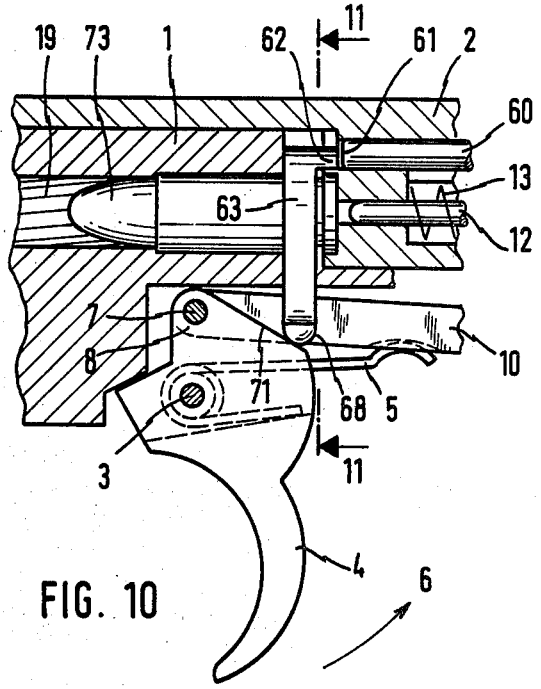
FIG. 10 is a longitudinal section through a fourth embodiment.

According to the embodiment of FIG. 9, where a similar locking device as described in connection with FIGS. 5 to 8 is shown, the trigger 4 is provided with a recess 50 in the region of its fork-shaped projection 8. A projection 51 protruding at right angles from the slide 16 engages in this recess. FIG. 9, like FIG. 7, illustrates the parts in the unlocked or firing position.

If the trigger 4, in its FIG. 9 position, is released, it is returned to its at-rest position by the spring 5 in the direction of the arrow 52. The projection 51 slides along the inner edge 53 of the recess 50 toward the pin 3. This causes the slide 16 to move downwardly to its locking position in which it prevents forward movement of the firing pin 12'. It will be understood that the firing pin will have been moved rearwardly by the spring 13 so that the slide 16 can move to its lower or locking position. The return movement of the trigger 4 is limited by the projection 51.

The embodiment of FIGS. 10–13 is a center fire pistol including a barrel 1 and a movable carriage 2. At the barrel 1, there is placed the trigger 4 which is manually pivotable against the action of the spring 5 in the direction of the arrow 6.

Figure 11:
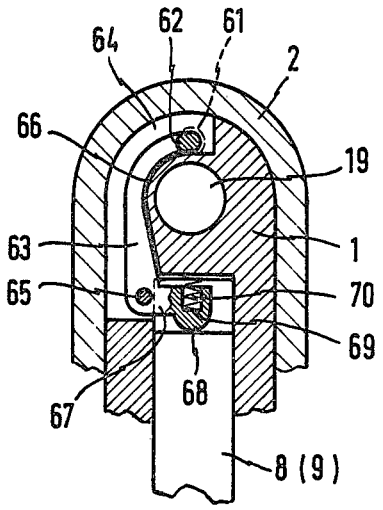
FIG. 11 is a sectional view taken along line 11—11 of FIG. 10.
Figure 12:
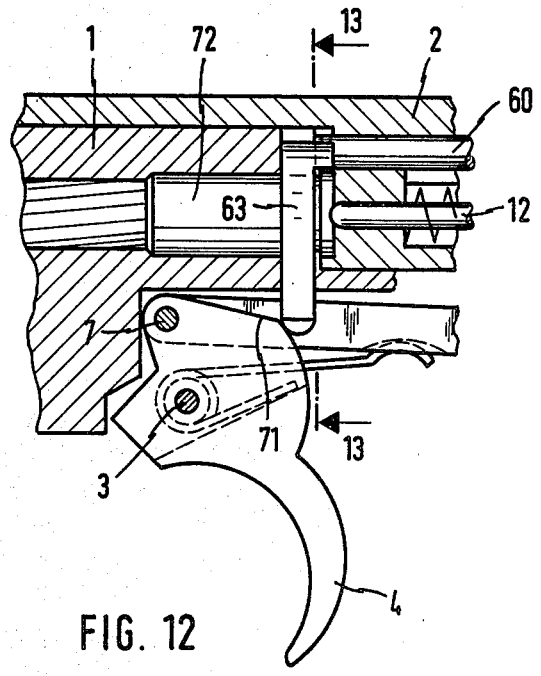
FIG. 12 is a longitudinal section similar to FIG. 11 showing another trigger position.
Figure 13:
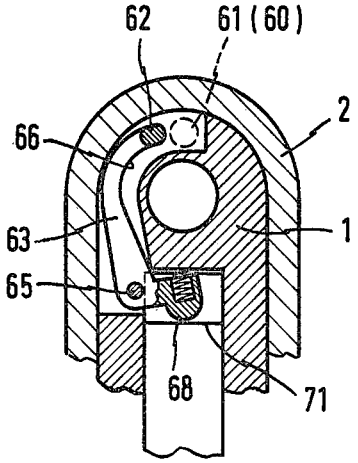
FIG. 13 is a sectional view taken along line 13—13 of FIG. 12.

The pin 7 holds a trigger rod 10 between the two fork-shaped projections 8 and 9 (not shown in FIG. 11).

The firing pin 12 is mounted in the carriage 2 for movement against the action of a compression spring; the firing pin 12 has at its rearward end a collar (not shown) whose side facing away from the barrel 1 is engaged by a projection, fork or the like of a rod 60 in the same manner as illustrated in FIG. 7. Thus the firing pin 12 is via the rod 60, the projection and the collar (not shown) held in the position shown in FIG. 10. The front end 61 of the rod 60 in this locked position abuts a small projection 62 which extends parallel to the hollow space 19 of the barrel 1 and is integral with a bow-shaped or arcuate pin 63. The projection 62 and pin 63 can be moved like a rocker arm about a pin 65. The inner edge 66 of the pin 63 which is movably mounted in a slit-like recess 64 extending vertically relative to the axis of the hollow space 19 of the barrel 1, abuts on a correspondingly milled edge of the barrel 1, which edge is at least in the region of the hollow space 19 adapted to the contour of the latter.

The shorter lever end 67 of the pin 63 has a rounded striking surface 68, and in an opening 69 there is a return spring 70 which with its upper end rests against the barrel 1.

If the trigger 4 is pulled in the direction of the arrow 6, the shorter lever end 67 of the pin 63 is displaced on the inclined plane 71 of the trigger 4 so that the pin 63 releases the frontal area 61 of the rod 60 to unlock the safety device. The firing pin 12 is thereby permitted to spring forward (see FIG. 12) to strike upon the cartridge case 72 so that the bullet 73 leaves the barrel.

Figure 14:
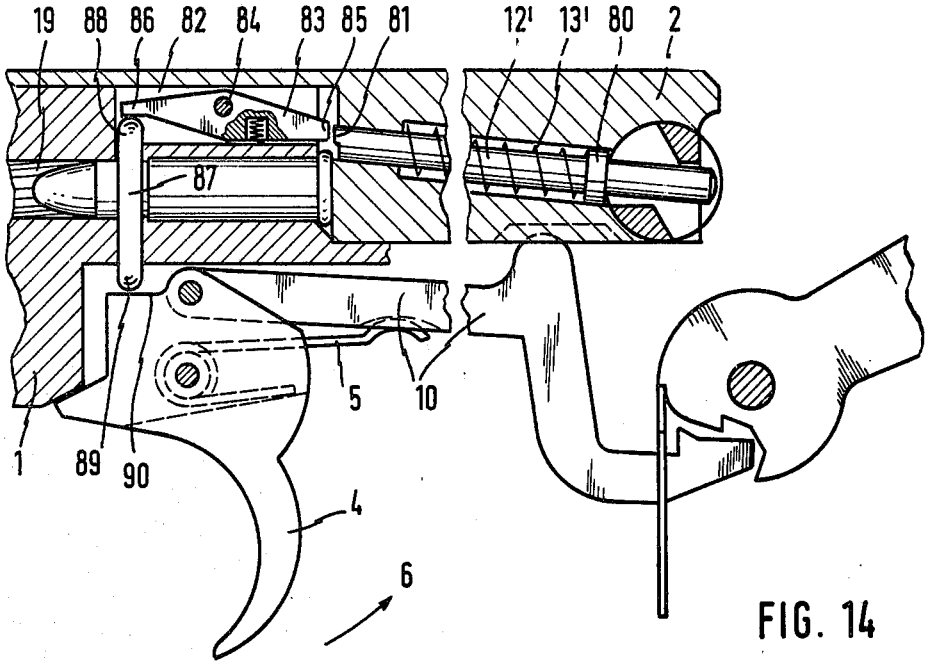
FIG. 14 is a longitudinal section through a fifth embodiment.
Figure 15:
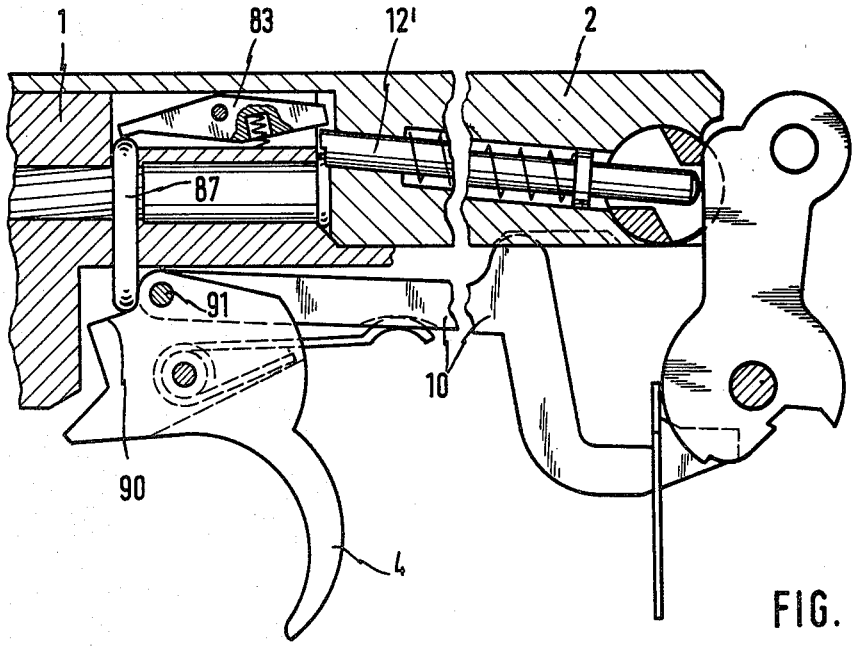
FIG. 15 is a longitudinal section similar to FIG. 14, showing another trigger position.

According to the embodiment shown in FIG. 14 and FIG. 15, the carriage 2 is movably placed on the barrel 1 of a rim fire pistol. The firing pin 12' including the compression spring 13' has a collar 80 and is stepped on its front side 81.

In a slit-shaped recess 82 extending in the longitudinal direction of the barrel, there is mounted a rocker arm 83 so that it is pivotable about a pivot pin 84. The rear end 85 of the rocker arm 83 is engageable with the firing pin 12' and the front end of the rocker arm 83 is engageable with a bow-shaped or arcuate pin 87. The pin 87 is mounted in the barrel 1 to be movable vertically relative to the hollow space 19 and has an upper projection 88 (vertical to the drawing plane) and a lower projection 89 (also vertical to the drawing plane). The pin 87 is formed such that it extends around the hollow space 19 of the barrel 1 and with its projection 88 grips under the rocker arm 83. The projection 89 is in engagement with an inclined surface 90 of the trigger 4.

If the locking device is in its locked position, the projection 88 extends under the end 86 of the rocker arm 83 so that the opposite end 85 of the rocker arm 83 prevents the firing pin 12' from moving forward. If the trigger is pulled in the direction of the arrow 6, the bow-shaped pin 87 slides downwardly on the striking surface 90 of the trigger 4 (FIG. 15).

In this embodiment, the bow-shaped pin 87 is placed in front of the pivot pin 91 for the trigger rod 10 and is thus practically completely guarded against an arbitrary releasing.

The spring 5 automatically returns the trigger in its position shown in FIG. 14 so that also the locking device returns automatically into its locking position.

I claim:

1. In a firearm having a barrel for receiving a cartridge, a firing pin having forward and rear ends and being movable between a cartridge-engaging firing position and an at-rest position and a trigger movable toward a firing position, an improved movable locking device for preventing movement of the firing pin to its firing position and, in response to movement of the trigger toward a firing position, for releasing said firing pin, said locking device being mounted in said barrel for movement between a locking position in which said device blocks movement of said firing pin to its firing position and an unlocking position in which said device is out of locking contact with said firing pin, said locking device including at least two movable elements one of which is located in front of the firing pin and frictionally connected to the trigger and another of which is engageable with the firing pin.

2. A firearm as in claim 1 wherein said other element is pivoted intermediate its ends to the barrel for swinging movement in a vertical plane transverse to the axis of the barrel.

3. A firearm as in claim 1 including a spring for biasing the locking device toward its locking position.

4. A firearm as in claim 1 wherein the locking device includes a vertically movable slide having a lower end engageable with the trigger, said slide being positioned laterally of the axis of the barrel.

5. In a firearm having a barrel for receiving a cartridge, a firing pin having forward and rear ends and being movable between a cartridge-engaging firing position and an at-rest position and a trigger movable toward a firing position, said trigger having a recess therein, an improved movable locking device for preventing movement of the firing pin to its firing position and, in response to movement of the trigger toward a firing position, for releasing said firing pin, said locking device being mounted in said barrel for movement between a locking position in which said device blocks movement of said firing pin to its firing position and an unlocking position in which said device is out of locking contact with said firing pin, said locking device including an element engageable in the recess in the trigger so as to be movable with the trigger.

6. In a firearm having a barrel for receiving a cartridge, a firing pin having forward and rear ends and being movable between a cartridge-engaging firing position and an at-rest position and a trigger movable toward a firing position, an improved movable locking device for preventing movement of the firing pin to its firing position and, in response to movement of the trigger toward a firing position, for releasing said firing pin, said locking device being mounted in said barrel for movement between a locking position in which said device blocks movement of said firing pin to its firing position and an unlocking position in which said device is out of locking contact with said firing pin, said locking device including a projection engageable with the forward end of the firing pin.

7. In a firearm having a barrel for receiving a cartridge, a firing pin having forward and rear ends and being movable between a cartridge-engaging firing position and an at-rest position and a trigger movable toward a firing position, an improved movable locking device for preventing movement of the firing pin to its firing position and, in response to movement of the trigger toward a firing position, for releasing said firing pin, said locking device being mounted in said barrel for movement between a locking position in which said device blocks movement of said firing pin to its firing position and an unlocking position in which said device is out of locking contact with said firing pin, said locking device including a vertically movable slide engageable with the trigger and a longitudinally movable rod having a forward end engageable with the slide and a rear end in engagement with the firing pin such that the rod and firing pin move together.

8. In a firearm having a barrel for receiving a cartridge, a firing pin having forward and rear ends and being movable between a cartridge-engaging firing position and an at-rest position and a trigger movable toward a firing position, an improved movable locking device for preventing movement of the firing pin to its firing position and, in response to movement of the trigger toward a firing position, for releasing said firing pin, said locking device being mounted in said barrel for movement between a locking position in which said device blocks movement of said firing pin to its firing position and an unlocking position in which said device is out of locking contact with said firing pin, said locking device including a pivoted lever engageable by the trigger and a slidable rod engageable at one end with the pivoted lever and at its opposite end with the firing pin.

9. A firearm as in claim 8 wherein said pivoted lever is bow-shaped and is arranged in a recess provided in the barrel above and laterally of the axis of the barrel.

10. In a firearm having a barrel for receiving a cartridge, a firing pin having forward and rear ends and being movable between a cartridge-engaging firing position and an at-rest position and a trigger movable toward a firing position, an improved movable locking device for preventing movement of the firing pin to its firing position and, in response to movement of the trigger toward a firing position, for releasing said firing pin, said locking device being mounted in said barrel for movement between a locking position in which said device blocks movement of said firing pin to its firing position and an unlocking position in which said device is out of locking contact with said firing pin, the locking device including a lever pivoted intermediate its ends for swinging movement in a vertical plane lying parallel to the axis of the barrel, the lever being positioned in a recess extending parallel to the axis of the barrel and a vertically movable element engageable with one end of the lever and with the trigger.

11. In a firearm having a barrel with a drilled hollow space for receiving a cartridge, a firing pin having forward and rear ends and being movable between a cartridge-engaging firing position and an at-rest position and a trigger movable toward a firing position, an improved movable locking device having at least one movable element for preventing movement of the firing pin to its firing position and, in response to movement of the trigger toward a firing position, for releasing said firing pin, said locking device being mounted in said barrel for movement between a locking position in which said device blocks movement of said firing pin to its firing position and an unlocking position in which said device is out of locking contact with said firing pin, said movable element being located within said barrel in front of said firing pin, frictionally connected to the trigger and surrounding at least partly said drilled hollow space for receiving a cartridge.

12. A firearm as in claim 11 including a biasing spring for pushing the movable element of said locking device toward its locking position.

* * * * *